United States Patent [19]

McAdams

[11] Patent Number: 4,869,607

[45] Date of Patent: Sep. 26, 1989

[54] LINE PRINTER RIBBON REVERSE MECHANISM

[75] Inventor: William C. McAdams, Melbourne, Fla.

[73] Assignee: Storage Technology Corporation, Louisville, Colo.

[21] Appl. No.: 76,133

[22] Filed: Jul. 21, 1987

[51] Int. Cl.[4] ..... B41J 33/20; B41J 33/44

[52] U.S. Cl. ..... 400/222; 400/219; 400/236.2

[58] Field of Search ..... 400/218, 219, 219.1, 400/221, 222, 236, 236.2, 246, 225, 234

[56] References Cited

U.S. PATENT DOCUMENTS

| | | | |
|---|---|---|---|
| 882,829 | 3/1908 | Kidder | 400/221 |
| 1,104,359 | 7/1914 | Kidder | 400/222 |
| 1,354,329 | 9/1920 | Moser | 400/221 |
| 2,858,928 | 11/1958 | Bristol | 400/222 |
| 3,367,470 | 2/1968 | Berill | 400/236.2 |
| 3,401,783 | 9/1968 | Norwood et al. | 400/236.2 |
| 3,825,103 | 7/1974 | Riley | 400/221 |

FOREIGN PATENT DOCUMENTS

| | | | |
|---|---|---|---|
| 263378 | 3/1964 | Australia | 400/219.1 |

OTHER PUBLICATIONS

"Single Motor Tape Drive"; P. R. Bareman et al.; *IBM Tech. Disc. Bull.;* vol. 24, No. 11B, pp. 5778–5779; Apr. 1982.

*Standard Handbook of Machine Design;* J. E. Shigley et al.; ©1986 McGraw Hill Book Company; pp. 30.7 & 30.8.

*Machine Design Fundamentals;* U. Hindhede et al.; ©1983 John Wiley and Son; pp. 492–495.

*Impact 5000® Series Theory Manual,* PN 3800014155, Change 1, Feb. 1987; date of original: Jan. 1986.

*Impact 5000® Series Operators Manual,* PN 3800014171, Change 8, Dec. 1987; date of original: Jan. 1986.

*Impact 5000® Series Maintenance Manual,* PN 3800014131, Change 8, Mar. 1988; date of orginal: Feb. 1986.

*Impact 5000® Series Interface Manual,* PN 3800014159, Change 3, Apr. 1987; date of original: Feb. 1986.

*Impact 5000® Series Installation Manual,* PN 3800014151, Change 8, Oct. 1987; date of original: Feb. 1986.

*Impact 5000® Series Illustrated Parts Catalog,* PN 3800014141, Change 11, Jan. 1988; date of original: Feb. 1986.

*Impact 5000® Series Logic Schematics,* PN 3800014161, Change 3, Feb. 1987.

*Primary Examiner*—David A. Wiecking

*Attorney, Agent, or Firm*—Dorr, Carson, Sloan & Peterson

[57] ABSTRACT

A ribbon reverse mechanism for a high-speed line printer having a towel ribbon driven between a pair of spring-loaded spools by gear means coupled to band drive motor includes an input shaft coupled to the drive motor and having mounted thereon a pair of spaced-apart worms for driving respective gears. The gears are each coupled a wrap-spring clutch, housed within a clutch stop collar having a plurality of teeth engageable with a floating disk, to an output shaft coupled to the spools. Each of the floating disks are alternately engaged to its respective clutch stop collar, thereby permitting the wrap spring clutch to be wound up, through energization of a coil. As one spool becomes full, a ribbon direction sensor outputs a signal indicative thereof to a machine co-processor in order that the active engagement may be de-energized, while the inactive engagement coil may be energized for reversing the direction of ribbon travel.

16 Claims, 2 Drawing Sheets

LINE PRINTER RIBBON REVERSE MECHANISM

BACKGROUND OF THE INVENTION

This invention relates generally to high-speed line printers employing towel ribbons, and more particularly to a ribbon reverse mechanism for such purpose.

As is well known, high-speed line printers typically comprise a flexible, endless character band, which is located directly in front of a hammerbank assembly including a plurality of print hammers, and which is rotated at a constant speed. In this manner, the characters on the band are successively presented to each hammer, which when energized drives the forms and ribbon against the raised character on the character band to print the selected character. The ribbon, sometimes referred to as a "towel ribbon" is rotated between the a pair of ribbon spools connected to respective drive shafts. Typically comprised of a 3–5 mil nylon material impregnated with ink, the ribbon is wound back and forth between the spools until its ink is depleted.

Prior art high-speed line printers, such as the IBM 1403 typically used a mechanical transmission bar at the end of the ribbon which would engage a ribbon direction sensor and therefore reverse the direction of the ribbon's winding. Other prior art approaches, such as the IBM 3211 printer, utilized a pair of motors with gear reduction (one for a respective spool) in conjunction with an end-of-ribbon bar which would hit toggle switch to change between motors and thereby reverse direction of the ribbon.

One problem with such prior art approaches, however, is the complexity of their transmission mechanisms as well as the duplication of motors required to drive the ribbon between its respective spools. It would, therefore, be desirable to provide a ribbon reverse mechanism which eliminated the requirement for additional drive motors and which simplified the mechanisms necessary to control movement of the towel ribbon.

SUMMARY OF THE INVENTION

Accordingly, it is a general object of the present invention to provide an improved ribbon reverse mechanism for a high-speed line printer. More specifically, it is an object of the present invention to provide such a ribbon reverse mechanism without the addition of extraneous parts.

Another object of the present invention is to provide an improved ribbon reverse mechanism which reduces power consumption requirements for its high-speed line printer by eliminating unnecessary motors.

Briefly, these and other objects of the present invention are accomplished by a ribbon reverse mechanism including a pair of electrical clutch means, each of the clutch means being coupled to a respective ribbon spool. An input shaft coupled to the band drive motor of the printer has co-axially mounted thereon a pair of spaced-apart worms for driving respective gears attached to the clutch means. A floating disk comprised of a ferrous material is mounted about and adapted to be engaged with a clutch stop collar to prevent movement of its respective clutch mechanism upon energization of an engagement coil which attracts the floating disk. It should be noted that the word "floating" as used with respect to each floating disk refers to an axial sliding relationship that the floating disks have with their clutch stop collars. When a particular engagement coil is energized, its respective floating disk will be attracted to such engagement coil, thereby causing that floating disk to slide axially along the clutch stop collar upon which it is mounted until it is fixedly engaged with the engagement coil. By selectively energizing the engagement coils of both of the clutch means upon indication that the ribbon has come to its end, the direction of travel of the ribbon may be changed in a simple manner.

These and other objects, advantages, and novel features of the present invention will become apparent from the following detailed description of the present invention when considered in conjunction with the accompanying drawings wherein:

DETAILED DESCRIPTION OF THE INVENTION

Figure 1:
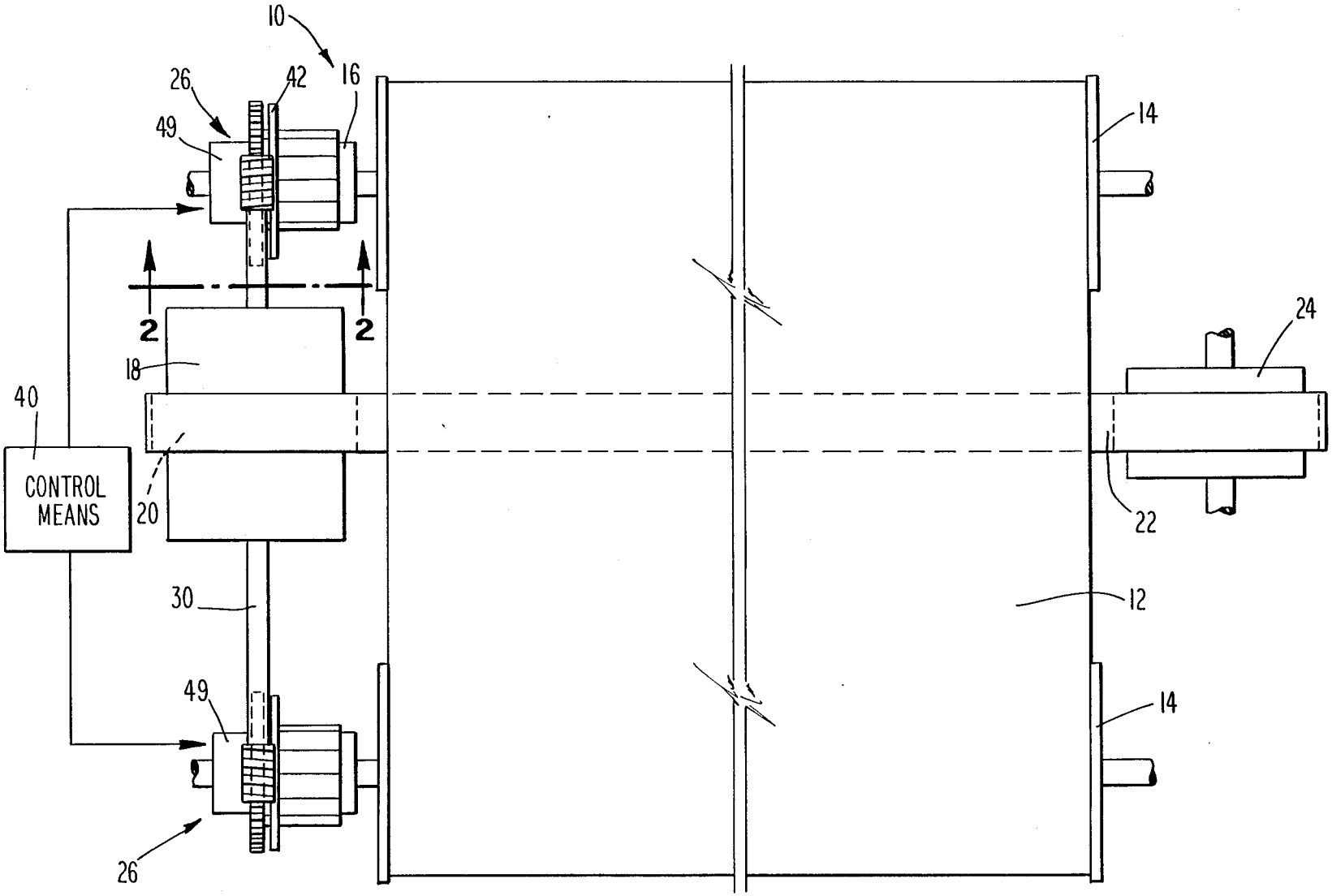
FIG. 1 illustrates the print gate assembly of a high-speed line printer which incorporates an electrical clutch mechanism in accordance with the present invention.

Referring now to the drawings, wherein like characters designate like or corresponding parts throughout the several views, there is shown in FIG. 1 a print gate assembly 10 of a high-speed line printer, such as the Impact 5000 Series printer manufactured by Documation Incorporation (now StorageTek Printer Corporation), a subsidiary of Storage Technology Corporation. As is conventional, the print gate assembly 10 includes a towel ribbon 12 wound between a pair of ribbon spools 14 coupled to respective feed hubs 16. A band drive motor 18 housed within a band pulley 20 drives a character band 22 for rotation in front of a hammerbank assembly (not shown). In such a manner, the band drive motor 18 increases system inertia for minimization of band jitter and print wiggle, and permits band speed changes without the need for belt and pulley changes commonly associated with such band speed changes. Band tension is achieved by a spring-loaded idler pulley 24 that permits the operator to easily change character bands 22.

Figure 2:
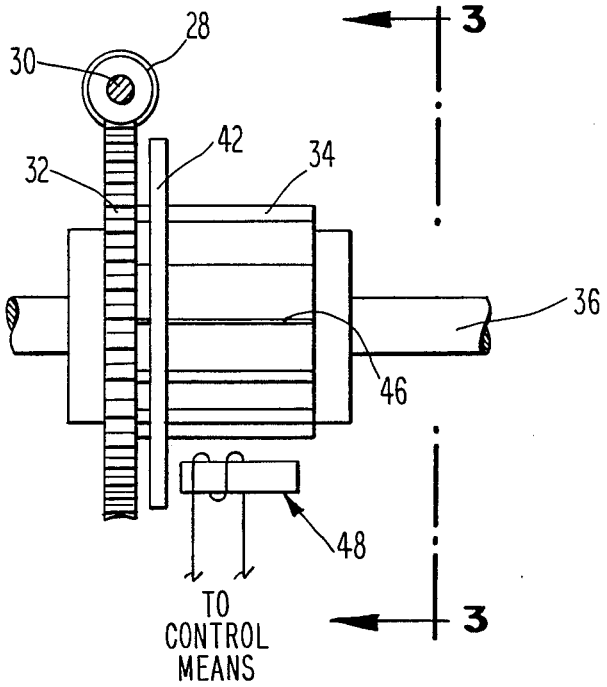
FIG. 2 shows the clutch mechanism of FIG. 1 taken along the lines 2—2.
Figure 3:
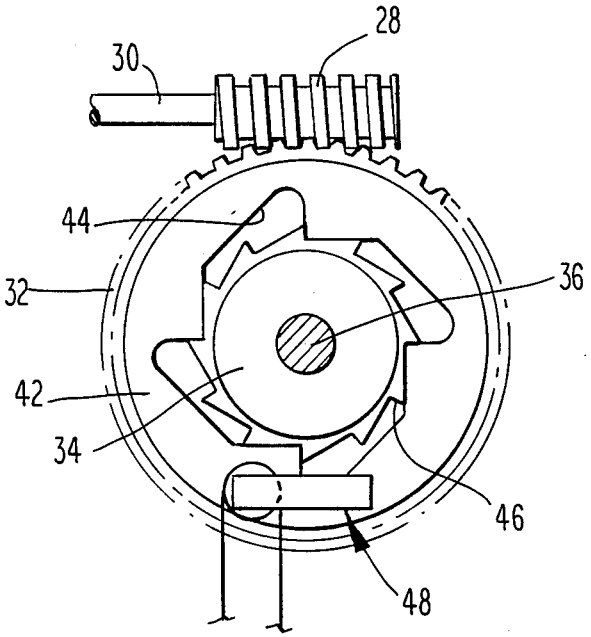
FIG. 3 illustrates a front view of the clutch mechanism shown in FIG. 2 taken along the lines 3—3.

The band drive motor 18 is also conveniently used to drive the ribbon 12 through a pair of gear and clutch sets 26, thereby permitting synchronization of ribbon speed to band speed at all print rates. As shown in FIG. 1, and referring now also to FIGS. 2 and 3, each gear and clutch set 26 is comprised generally of a worm 28 coupled to an input shaft 30 driven by the band drive motor 18, a gear 32 engaged with each respective worm 28, and a clutch stop collar 34 containing a conventional wrap-spring clutch 35 coupled between an output shaft 36 and an input hub 49 and shaft 37 to which the gear 32 is co-axially mounted.

In accordance with a presently preferred embodiment of the invention, the gear 32 dynamically slips on the input hub 49 at approximately 40 inch-pounds. The worms 28 each comprise a double thread worm having a pitch diameter of approximately 0.44 inches, a lead angle of substantially 8 degrees, and a lead of approximately 0.2 inches. Likewise, the gear 32 comprises a wheel having 80 teeth, a pitch angle of substantially 20 degrees and a 32 pitch. In order for a control means 40

(FIG. 1) to be able to alternately engage and disengage the gear and clutch sets 26, the worm/gear combination installed at the upper ribbon spool 14 comprises a left-hand helix with a clockwise input, while the worm/gear combination coupled to the lower ribbon spool 14 comprises a right-hand helix with a counterclockwise input. Drag-torque input-to-output provided by the wrap-spring clutch 35 is acceptably constrained within the range of from 3 to 7 inch-pounds.

In order to engage and disengage the gear and clutch sets 26, a floating disk 42 having a ratchet opening 44 adapted to engage the teeth 46 of the clutch stop collar 34, is used in conjunction with electromagnetic means 48 comprising an engagement coil which may be coupled to the control means 40 for its energization.

In a conventional manner a ribbon direction sensor (not shown) senses the direction of the ribbon travel. As one spool 14 becomes full, means such as a ribbon reverse actuating bar (not shown) trips the sensor, thereby enabling the control means 40 to select active and inactive skew motors as well as alternately energizing the engagement coils 48. Further information relating to such ribbon control sensors and their operability within the Impact 5000 Series printers manufactured by Documation Incorporated may be found in the following Documation Incorporated publications, each of which are incorporated herein by reference: "Theory of Operation"-3800014155; "Product Description Manual"-EP-026-0; "Operator's Manual"-380001471; "Maintenance Manual"-3800014131; "Interface Feature Manual"-3800014159; "Installation Manual"-3800014151; "Illustrated Parts Catalog"-3800014141; and "Schematics"-3800014161.

As noted hereinabove, when one spool becomes full, the control means 40 receives an indication thereof from the ribbon direction sensor (not shown), energizes one engagement coil 48 and de-energizes the other engagement coil 48. For example, referring to FIGS. 1–3, and assuming that the direction of ribbon travel is "up" as shown by the arrow in FIG. 1, the upper ribbon spool 14 and its associated gear and clutch set 26 will be engaged through energization of the engagement coil 48 (mounted to the printer frame) and will thereby attract its corresponding floating disk 42 for engaging the clutch stop collar 34. That is, the floating disks 42 normally spin freely so long as their respective engagement coils 48 are not actuated by the control means 40. However, when an engagement coil 48 is so actuated, its respective floating disk 42 is electromagnetically attracted (as shown by the arrow in FIG. 2) into a fixed relationship with the actuated engagement coil 48, thereby stopping rotation of the respective coller 34 and causing the wrap-spring clutch 35 within the engaged clutch stop collar 14 to begin tightening. As a result, the output shaft 36 takes up the ribbon 12. On the other hand, the gear and clutch set 26 associated with the lower ribbon spool 14 is disengaged through de-energization of its respective coil 48, thereby permitting its respective floating disk 42 to spin freely. When the upper ribbon spool 14 becomes full, as indicated to the control means 40 by the ribbon direction sensor (not shown), the engagement coil 48 of the upper gear and clutch set 26 will be de-energized by the control means 40 while the engagement coil 48 of the lower gear and clutch set 26 will be energized, thereby engaging its floating disk 42 to the clutch stop collar 34 and causing the ribbon 12 to be drawn in a "down" direction with reference to FIG. 1. Both floating disks 42 are suitably comprised of a ferrous material (e.g. cold rolled steel) with an electroless nickel plating in order to prevent rust and to provide a non-ferrous air gap upon deenergization so that a residual magnetism may not be set up therein.

Obviously, many modifications and variations of the present invention are possible in light of the above teachings. It is therefore, to be understood that within the scope of the appended claims, the invention may be practiced otherwise than as specifically described.

What is claimed is:

1. An improved ribbon reverse mechanism for a high-speed line printer having a towel ribbon driven between a pair of spools by gear means coupled to a band drive motor, the improvement comprising in combination therewith:

a pair of output shafts, each said output shaft coupled to a respective one of the spools;

a clutch stop collar coupled to each said output shaft;

a pair of wrap-spring clutches, each said wrap-spring clutch being mounted within a respective one of said clutch stop collars, and coupling the gear means to a respective of said output shafts;

a floating disk co-axially coupled to an axial sliding relationship upon said clutch stop collar; and means for fixedly engaging each said floating disk, with its respective clutch stop collar, to wind up its respective wrap-spring clutch to drive its respective output shaft, and thereby wrap the towel ribbon upon the spool to which said driven output shaft is coupled.

2. The improvement according to claim 1, wherein each said clutch stop collar comprises a substantially cylindrical hollow element surrounding its respective wrap-spring clutch, said element having a plurality of teeth radially disposed about an outside surface thereof.

3. The improvement according to claim 2, wherein each said floatiing disk comprises a ferrous material having a ratchet opening corresponding to said plurality of teeth.

4. The improvement according to claim 3, wherein said floating disk further comprises a plating of electroless nickel.

5. The improvement according to claim 3, wherein said engaging means comprises electromagnetic means for attracting each said floating disk into a fixed relationship against said electromagnetic means.

6. The improvement according to claim 5, wherein said electromagnetic means comprises:

a pair of engagement coils, each said engagement coil affixed to the printer proximate to a respective one of the spools; and means for alternatingly actuating each said engagement coil, whereby said actuating means is adapted such that one said engagement coil is operable upon deactuation of the other said engagement coil.

7. Apparatus for reversibly driving a towel ribbon in a high-speed line printer between a pair of ribbon spools, comprising:

a band drive motor;

a first shaft means driven by said band drive motor;

a pair of worms co-axially mounted spaced apart upon said first shaft means;

a pair of gears, mounted on respective input hubs, each of which is adapted to be driven by a respective one of said worms;

a pair of clutches, each said clutch respectively coupled to each said gear;

a pair of clutch stop collars, each said stop collar operatively coupled to and housing a respective one of said clutches;

a pair of feed hubs, each said feed hub connected to a respective one of said stop collars;

second and third shaft means coupled respectively between correspondiing ones of said feed hubs and the ribbon spools;

a pair of disks, each said disk co-axially coupled for rotation with a respective one of said stop collars; and means for fixedly engaging each said disk with its respective stop collar, thereby engaging its associated clutch to selectively transmit torque to said second and third shaft means.

8. The apparatus according to claim 7, wherein each said clutch comprises a wrap-spring clutch.

9. The apparatus according to claim 7, wherein each said worm comprises a double threaded worm having a pitch diameter of approximately 0.44 inches, a lead angle of substantially 8 degrees, and a lead of approximately 0.2 inches.

10. The apparatus according to claim 7, wherein one of said pair of gears driven by its respective worm comprises a right-hand helix while another of said pair of gears driven by its respective worm comprises a left-hand helix.

11. The apparatus according to claim 7, wherein each said gear comprises a wheel having 80 teeth, a pitch angle of substantially 20 degrees, and a 32 pitch.

12. The apparatus according to claim 7, wherein each said stop collar comprises a substantially cylindrical hollow element surrounding its respective clutch, said element having a plurality of teeth radially disposed on an outside surface thereof.

13. The apparatus according to claim 12, wherein each said disk comprises a ferrous material having a ratchet opening corresponding to said plurality of teeth.

14. The apparatus according to claim 13, wherein said disk further comprises a plating of electroless nickel.

15. The apparatus according to claim 13, wherein said engaging means comprises electromagnetic means for attracting each said disk.

16. The apparatus according to claim 15, wherein said electromagnetic means comprises:

a pair of engagement coils, each said engagement coil affixed to the printer proximate to a respective one of the spools; and means for alternatingly actuating each of said engagement coil, whereby said actuating means is adapted such that one said engagement coil is operable upon deactuation of the other said engagement coil.

* * * * *